US006026542A

United States Patent [19]

Lu

[11] Patent Number: 6,026,542

[45] Date of Patent: Feb. 22, 2000

[54] RETRACTABLE HANDLE DEVICE

[75] Inventor: Lien-Ching Lu, Miao Li Hsien, Taiwan

[73] Assignee: Ting Cheng Co., Ltd., Miao Li Hsien, Taiwan

[21] Appl. No.: 09/040,345

[22] Filed: Mar. 18, 1998

[51] Int. Cl.[7] ..... A47B 95/02

[52] U.S. Cl. ..... 16/113.1

[58] Field of Search ..... 190/18 A, 115; 280/655, 655.1, 47.31, 47.315; 16/113.1, 405, 429

[56] References Cited

U.S. PATENT DOCUMENTS

| | | | |
|---|---|---|---|
| 5,502,876 | 4/1996 | Wang | 16/115 |
| 5,836,052 | 11/1998 | Chou | 16/115 |
| 5,875,520 | 3/1999 | Chang | 16/115 |

*Primary Examiner*—Chuck Y. Mah

*Attorney, Agent, or Firm*—Rosenberg, Klein & Lee

[57] ABSTRACT

A retractable handle device is provided which includes two sleeves, two inner tubes disposed in the corresponding sleeves, and a handle mechanism that respectively receives the inner tubes on opposing ends thereof. Two position-control devices are located at the bottom end of corresponding inner tubes. The handle mechanism has a press bar mounted in a lower casing thereof. Each position-control device has a locating block fastened to the bottom end of the corresponding inner tube, a flat latch, biased by a spring, engaging a locating hole on the corresponding sleeve to stop the respective inner tube from axial movement relative to the corresponding sleeve. A respective swivel driving element rotates about a pivot pin in each locating block and is coupled to one end of the corresponding flat latch and controlled by the press bar through a respective link to pull the flat latches away from the respective locating holes in the corresponding sleeves, so that the inner tubes can be axially moved relative to the sleeves.

2 Claims, 4 Drawing Sheets

RETRACTABLE HANDLE DEVICE

BACKGROUND OF THE INVENTION

The present invention relates to a retractable handle device for a suitcase. More particularly, the retractable handle with a position-control device is practical in use.

FIG. 1 shows a conventional handle device of a suitcase, in which also has the position-control action, but there are some drawbacks in this mechanism. One of the drawbacks is that the components of the device are too complex to be assembled easily, and the other is that the latch block 152 tends to be tilted when the forced by the beveled driving block 132 of the corresponding link 13 (see the dotted line in FIG. 1), thereby causing the latch block 152 to be retained in the locating hole 161 on the corresponding sleeve 16 to stop the corresponding inner tube 14 from axial movement relative to the corresponding sleeve 16.

SUMMARY OF THE INVENTION

The present invention has been accomplished to provide a retractable handle device without the aforesaid drawbacks. It is one object of the present invention to provide a retractable handle device which has a simple structure of position-control device for controlling the position of the inner tubes. It is another object of the present invention to provide a position-control device for a retractable handle which controls locking and unlocking of the inner tubes positively. Accordingly, a retractable handle device comprises a locating block at the bottom end of each inner tube thereof, which is disposed in a respective sleeve, a flat latch forced by a spring out of the locating block at each inner tube through a hole on the inner tube into engagement with a locating hole on the corresponding sleeve to stop the respective inner tube from axial movement relative to the corresponding sleeve, a swivel driving element turned about a pivot pin in the locating block at each inner tube and coupled to one end of the corresponding flat latch and controlled by a handle mechanism through a respective link to pulled the corresponding flat latch away from the corresponding locating hole on the corresponding sleeve for permitting the corresponding inner tube to be moved axially in and out of the corresponding sleeve.

DETAILED DESCRIPTION OF THE PREFERRED EMBODIMENT

Figure 1:
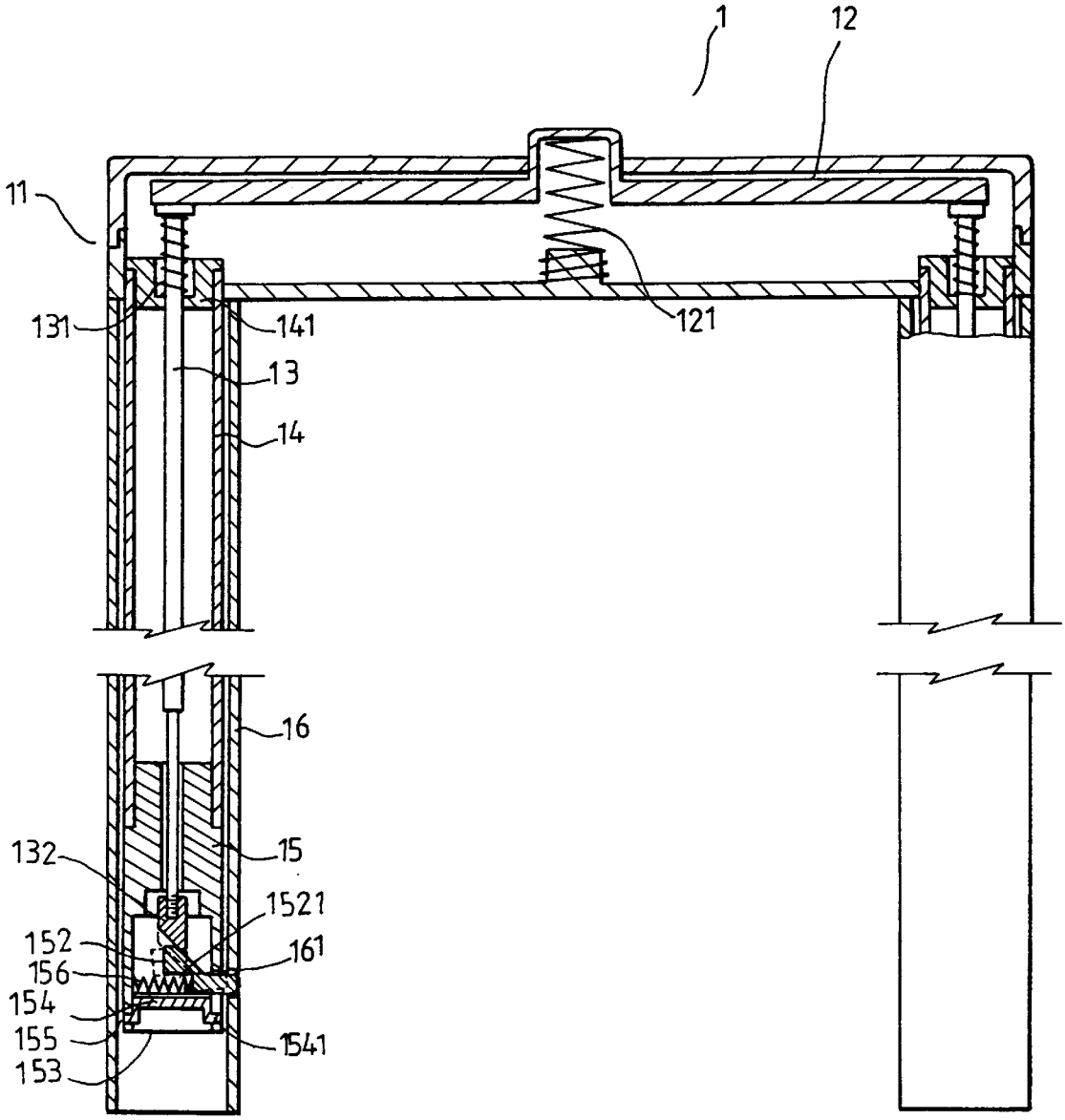
FIG. 1 PRIOR ART
FIG. 1 a sectional view showing a retractable handle device according to the prior art.
Figure 2:
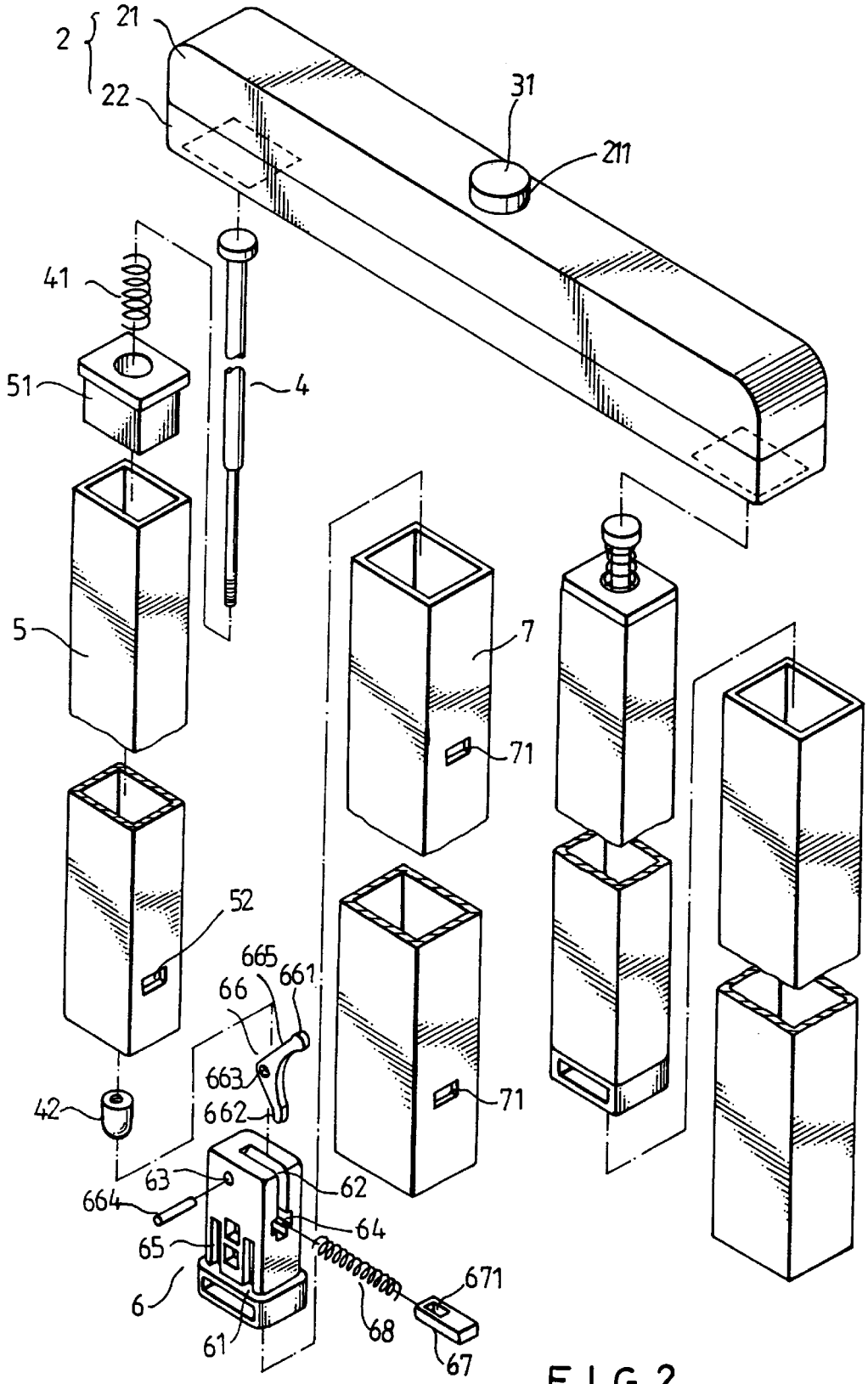
FIG. 2 is an exploded view of a retractable handle device according to the present invention.

Referring to FIGS. from 2 to 4, a retractable handle device in accordance with the present invention comprises two parallel sleeves 7, two inner tubes 5 disposed in the sleeves 7, and a handle mechanism 2 connected between the inner tubes 5 outside the sleeves 7. The handle mechanism 2 is comprised of an upper casing 21, a lower casing 22 and a press bar 3 being mounted on the lower casing 22. The upper casing 21 has a through hole 211 at its top center. A spring 32 is mounted on a projection of post 321 inside the lower casing 22 to support a hollow press cylinder 31 of the press bar 3, and to force the hollow press cylinder 31 out of the through hole 211. The inner tubes 5 are respectively mounted in two bottom coupling holes 220 at both ends of the lower casing 22 of the handle mechanism 2. Each inner tube 5 has a top end cap 51 respectively fixed to the bottom coupling holes 220, and a side hole 52 at an inner side near its bottom end. A pair of position-control device 6 is fastened to the respective bottom end of inner tubes 5. A pair of elongated and headed links 4 is disposed respectively in inner tubes 5. Each of the bottom end of links 4 mounted with an end cap 42. A spring 41 is mounted in the top end cap 51 of each inner tube 5, imparting an upward pressure to the corresponding link 4 against the handle mechanism 3. Each sleeve 7 has a plurality of locating holes 71 at an inner side near top and bottom sides.

Each of position-control devices 6 comprises an outward bottom flange 61 stopped outside of the bottom end of the corresponding inner tube 5, a longitudinal slot 62 extended to the top, a transverse pin hole 63 intersected with the longitudinal slot 62, a pivot pin 664 mounted in the transverse pin hole 63, a swivel driving element 66 turned about the pivot pin 664 in the longitudinal slot 62, a transverse locating hole 64 at the bottom of the longitudinal slot 62, a spring 68 mounted in the transverse locating hole 64, and a latch 67 coupled to the spring 68 in the transverse locating hole 64 and forced outwards by the spring 68 into the side hole 52 on the corresponding inner tube 5, and recesses 65 reinforced the position-control device 6. The latch 67 has a hook hole 671 at the rear end thereof. The swivel driving element 66 is an angled bar having a pivot hole 663 on the middle which receives the pivot pin 664, a rounded top end 661 maintained in contact with the end cap 42 of the corresponding link 4, and a hooked bottom end 662 hooked in the hook hole 671 at the rear end of the latch 67 adjacent to the spring 68.

Figure 3:
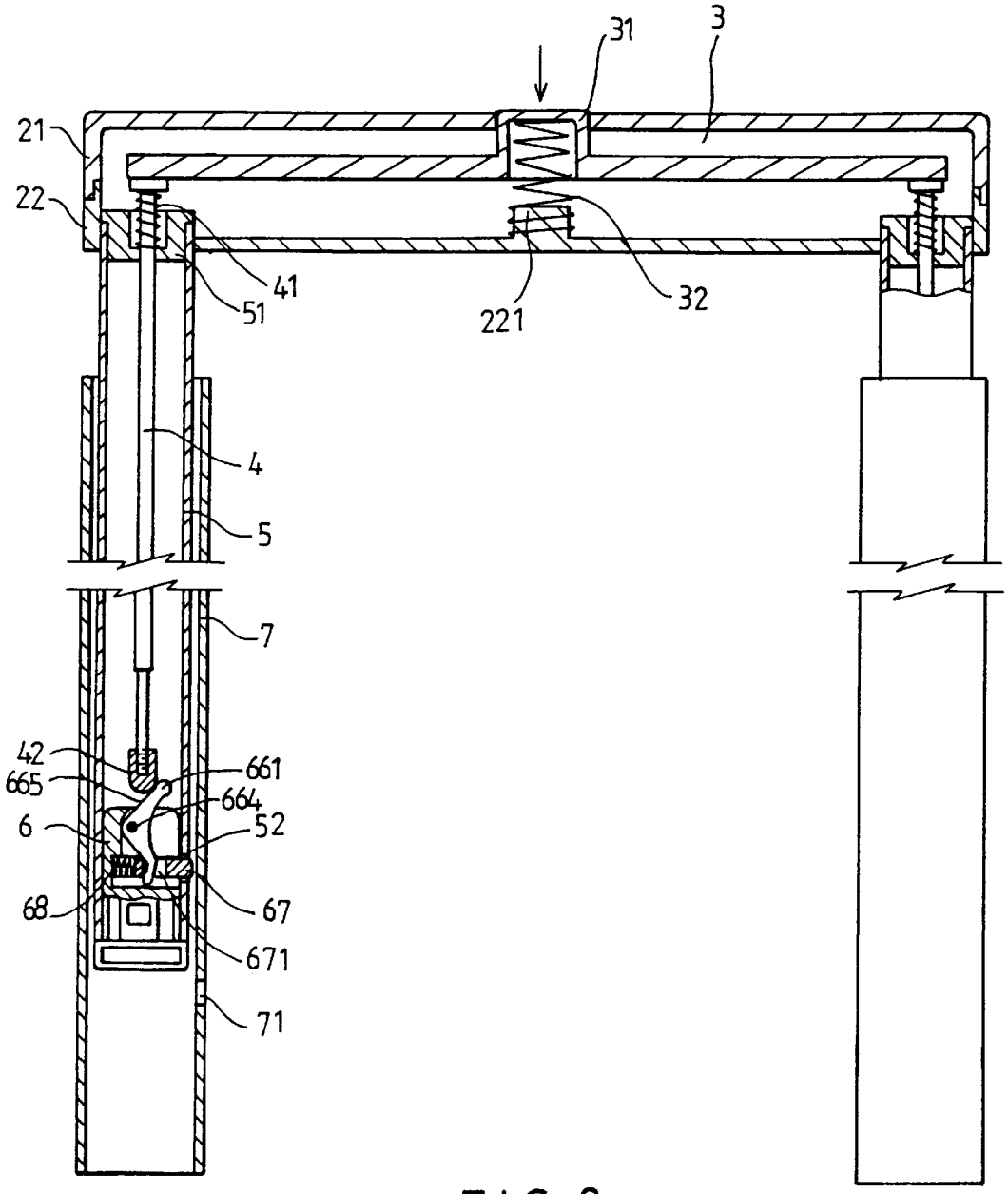
FIG. 3 is a sectional view of the present invention, showing the latch disengaged from the locating holes on the sleeve.

Referring to FIG. 3 again, when the press bar 31 of the handle mechanism 3 is depressed, the links 4 are lowered in the inner tubes 5 to compress the springs 41 and to move the respective end caps 42 along top arm portions 665 of the swivel driving elements 66, thereby causing the swivel driving elements 66 to be turned about the respective pivot pins 664 and the latches 67 to be respectively pulled backwards to compress the respective springs 68, and therefore the latches 67 are moved out of the locating holes 71 on the sleeves 7, permitting the inner tubes 5 to be moved with the handle mechanism 2 upwards or downwards relative to the sleeves 7.

Figure 4:
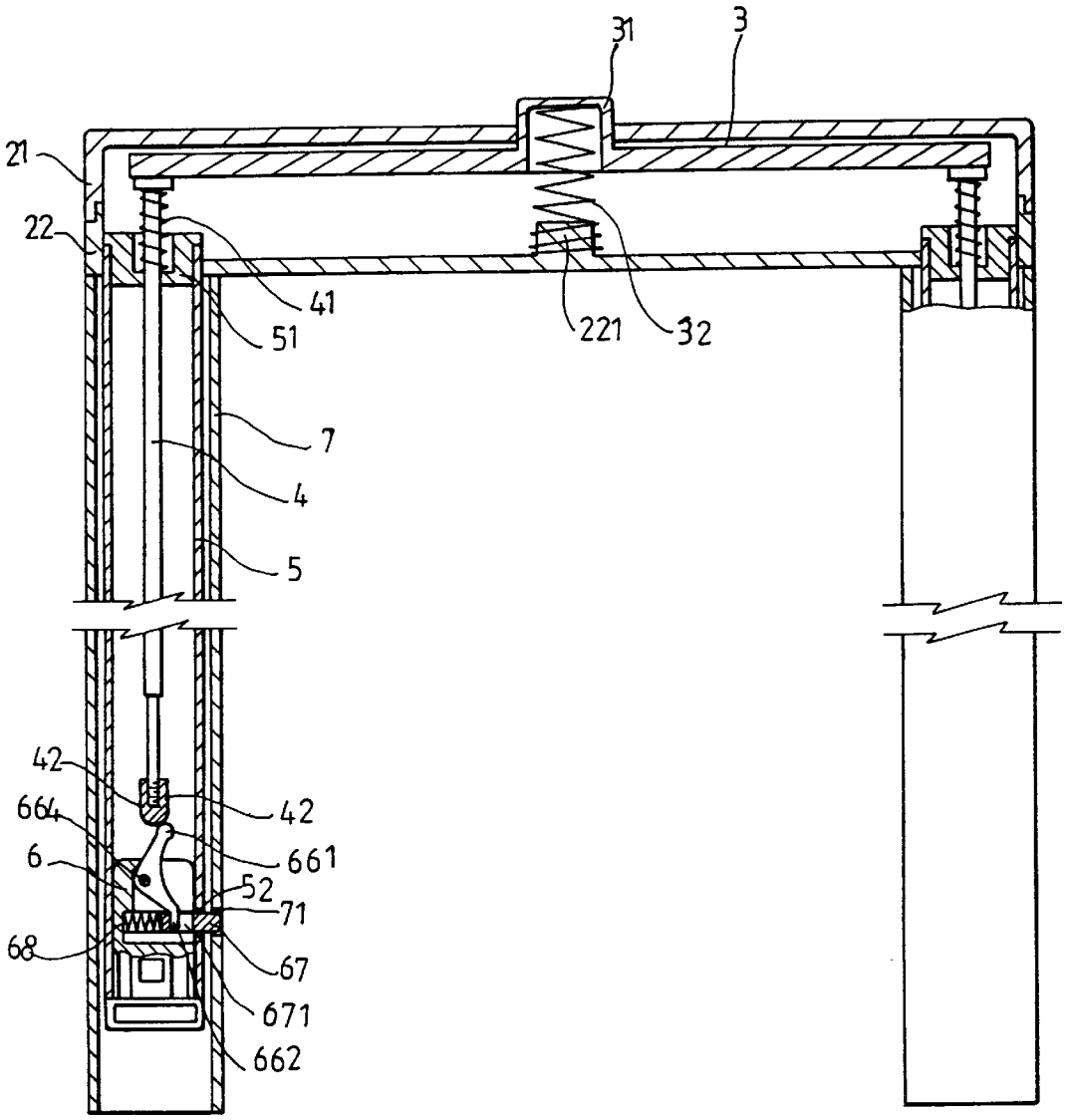
FIG. 4 is similar to FIG. 3 but showing the latch forced into engagement with one locating hole on the sleeve.

Referring to FIG. 4, when the press bar 31 of the handle mechanism 3 is released from the hand, the springs 41 immediately push the links 4 upwards back to their former position, and the springs 68 immediately push the respective latches 67 outwards, thereby causing the latches 67 to be engaged into the upper or lower locating holes 71 on the sleeves 7 to secure the inner tubes 5 at the extended position.

While only one embodiment of the present invention has been shown and described, it will be understood that various modifications and changes could be made thereunto without departing from the spirit and scope of the invention disclosed.

I claim:

1. A retractable handle device comprising:

a pair of sleeves disposed in spaced parallel relationship, each of said sleeves having a plurality of locating holes formed through an inner side thereof;

a pair of inner tubes respectively disposed in said pair of sleeves, each of said inner tubes having a side hole formed therethrough adjacent a bottom end of said inner tube;

a handle mechanism having a lower casing, a press bar mounted on said lower casing, and an upper casing covering said lower casing, said lower casing having a post projecting therefrom with one end of a first spring positioned on said post and a pair of coupling holes respectively formed through a bottom of said lower casing adjacent opposing ends of said lower casing for respectively receiving said pair of inner tubes therein, said press bar having a hollow press cylinder to receive an opposing end of said first spring therein, said upper casing having a centrally disposed hole formed therethrough for receiving said hollow press cylinder therein;

a pair of top end caps respectively coupled to upper ends of said pair of inner tubes, each of said top end caps having an aperture formed through an upper end thereof and a recess surrounding said aperture;

a pair of second springs respectively disposed in said recesses in said pair of top end caps;

a pair of links respectively disposed in said pair of inner tubes, each of said links extending through said aperture of a respective top end cap and being biased by a respective second spring into contact with said press bar, each of said links having a end cap formed at a bottom end thereof;

a pair of position-control devices respectively mounted to a bottom end of said inner tubes, each of said position-control devices having (a) a locating block fastened to the bottom end of the corresponding inner tube, said locating block having an outwardly extending bottom flange stopped outside of the bottom end of the corresponding inner tube, (b) a longitudinal slot extending to a top side of said position-control device, (c) a transverse pin hole intersecting said longitudinal slot, (d) a transverse locating hole formed at a bottom side of said longitudinal slot, (e) a pivot pin mounted in said transverse pin hole, (f) a third spring mounted in said transverse locating hole, (g) a latch coupled to said third spring and being outwardly biased by said third spring through said side hole on the corresponding inner tube into engagement with one of said locating holes in the corresponding sleeve to stop the respective inner tube from axial movement relative to the respective sleeve, said latch having a hook hole formed therein adjacent a rear end thereof, and (h) a swivel driving element formed by an angled bar having a centrally disposed pivot hole formed therethrough and disposed in said longitudinal slot, said pivot pin passing through said pivot hole, said swivel driving element having a rounded top end maintained in contact with the end cap of the corresponding link and a bottom end hooked in the hook hole on said latch.

2. A retractable handle device as claimed in claim 1, wherein the swivel driving element being turned about said pivot pin in one direction to pull said latch backwards out of the locating holes on the respective sleeve for permitting the respective inner tube upwards and downwards in the respective sleeve when said handle mechanism is operated to lower said links.

* * * * *